United States Patent [19]

Küpper

[11] 4,442,979

[45] Apr. 17, 1984

[54] SPREADER VEHICLE FOR SOLID AND LIQUID THAWING MATERIALS

[76] Inventor: Willy Küpper, Eichhölzleweg 11, D-7715 Bräunlingen, Fed. Rep. of Germany

[21] Appl. No.: 304,166

[22] Filed: Sep. 21, 1981

[30] Foreign Application Priority Data

Sep. 19, 1980 [DE] Fed. Rep. of Germany ..... 3035360

[51] Int. Cl.[3] ..... E01C 19/20

[52] U.S. Cl. ..... 239/656; 239/663; 239/673; 239/677

[58] Field of Search ..... 239/656, 662, 663, 664, 239/673, 675, 677, 681, 682, 684, 155, 156, 214.25

[56] References Cited

U.S. PATENT DOCUMENTS

| | | | |
|---|---|---|---|
| 2,661,955 | 12/1953 | Sherer | 239/656 |
| 2,947,544 | 8/1960 | Hurt | 239/675 |
| 3,344,993 | 10/1967 | Wilder | 239/663 |
| 3,401,890 | 9/1968 | Middlesworth | 239/662 |

FOREIGN PATENT DOCUMENTS

| | | | |
|---|---|---|---|
| 223422 | 8/1959 | Australia | 239/681 |
| 255359 | 7/1926 | United Kingdom | 239/684 |

*Primary Examiner*—John J. Love
*Assistant Examiner*—Jon Rastello
*Attorney, Agent, or Firm*—McGlew and Tuttle

[57] ABSTRACT

A spreader of granulated and liquid material, for a vehicle comprises, a granulated material vessel having three feed troughs extending substantially along a longitudinal axis of the vehicle. A conveyor with hydraulic motor is positioned in each feed trough and feeds granulated material to three distributor units. A liquid material vessel is also provided which includes liquid supply lines to each of the distributor units. Each liquid supply line has a hydraulic motor-powered pump. Two of the feed troughs which are positioned on either sides of the longitudinal axis of the vessel include granulated material feed lines connected between the respective feed trough and its associated distributor unit so that a distributor plate of each of the associated distributor units is positionable beyond the side contours of the vehicle, and on either side of the vehicle, to increase the potential width of coverage with the spread material.

27 Claims, 11 Drawing Figures

SPREADER VEHICLE FOR SOLID AND LIQUID THAWING MATERIALS

FIELD AND BACKGROUND OF THE INVENTION

The invention relates to a spreader vehicle for solid, granulated, and liquid thawing materials which are taken out of separate vessels and supplied to impellers in quantities proportional to the speed of travel and adjustable to selectable scatter densities.

In all spreader vehicles and spreader implements known until now, which carry solid and liquid thawing materials simultaneously, the liquid thawing materials are not spread separately but are used only to moisten the solid thawing materials (e.g. German Pat. No. 1 936 564, German Pat. No. 2632 794, German OS No. 1 534 296, German OS No. 1 459 760, German AS No. 1 299 013, Swiss Pat. No. 516 050).

Devices are also known for spraying a thawing salt solution on traffic areas where a spray device with spray nozzles is mounted on a vehicle, to which the thawing salt solution is supplied by a liquid pump from a liquid tank carried by the vehicle. The thawing salt solution is delivered to the spray device in quantities which are adjustable as a function of travel speed. With this device, however, solid thawing materials cannot be scattered. In addition, it has been found in practice that spray nozzles, to which the liquid to be sprayed must be supplied will, at a relatively high pressure for a spraying effect to be obtained at all, cause too much nebulization of the liquid, so that such spray devices for the treatment of icy roads cannot be used on the one hand for reasons of environmental protection and on the other for reasons of thrift.

Spreader implements are also known (German Pat. No. 2 011 894) which can be placed on the loading platform of a vehicle and with which scatter substances different from one another, e.g. gravel and salt, can be scattered simultaneously or separately from each other and which comprises two separate vessels, each with a belt conveyor and a distributor plate. In addition, these spreader implements have a control device for the travel speed-dependent drive of the belt conveyor and for the setting of different constant drive speeds of the distributor plates. The drives of the belt conveyors and of the distributor plates of both vessels are adapted to be switched on singly or jontly. The two vessels and their belt conveyors are arranged in paralle, side by side in the direction of the longitudinal vehicle axis and are equipped with a distributor plate at the rear end of each belt conveyor. At least one of the plates are pivotable about an eccentric vertical axis and fixable into any desired position.

With these so-called double spreader implements only solid granulated scatter substances can be scattered. With the simultaneous use of both spreader devices, double the scatter width of a single spreader device can be obtained, so that also relatively wide roads can be covered in one spreading operation. However, the maximum attainable scatter width is only about 10 meters, this being attributable in particular to the fact that the two spreading devices are arranged close together and permit a spreading angle of at most 90° if a homogeneous scatter densityiis to be ensured. Liquid thawing materials alone cannot be scattered with these known spreaders.

SUMMARY OF THE INVENTION

It is the object of the present invention to provide a spreader vehicle of the above mentioned kind with which one can scatter selectively, separately or mixed, liquid and solid thawing materials in one operation over a maximum width of about 25 meters as well as in any narrower width with homogeneous scatter density, and withwhich, when liquid thawing material are spread separately, a fog-forming spray effect is largely avoided.

Accordingly, another object of the invention is to provide a spreader of granulated and liquid thawing material for a vehicle having a longitudinal axis which comprises a granulated material vessel having a plurality of feed troughs each with a granulated material outlet, a conveyor in each trough for conveying the granulated material to the outlet, a hydraulic motor connected to each conveyor, the liquid material vessel on the vehicle, distributor means connected to the vessel and to each trough outlet. Each distributor means includes a rotatably mounted distributor plate which is driven by a hydraulic motor, a granulated material conduit connected connected to a respective trough outlet and a liquid material conduit. The liquid material vessel includes a liquid supply line which is connected to each liquid material conduit of a respective distributor means. A liquid pump, driven by a hydraulic motor, is connected to each liquid supply line. Hydraulic control means are also provided which are connected to each of the hydraulic motors to selectively and adjustably operate these motors so that an adjustable rate of flow for at least one of the granulated and liquid materials is established, which flow is also proportional to the rate of speed of the vehicle. A feed conduit for granulated material is connected between at least one, and preferably two or three trough outlets, and the granulated material conduit of a respective distributor means. The feed conduit is movable into a substantially transverse position with respect to the vehicle axis and has a length so that the respective distributor means is positioned outwardly and beyond the outer side contour of the vehicle. The feed conduit includes a feed conveyor and connected hydraulic motor which is also connected to the hydraulic control means to be activated with activation of the conveyor of the connected trough.

Such a spreader vehicle is intended and suitable especially for control of winter slipperiness, whether due to snow or ice, on takeoff and landing strips of airports. A special advantage is to be seen also in that by the scattering of liquid thawing materials alone or by the scattering of a mixture of liquid and solid thawing materials, the formation of slipper surface can be prevented. Using the separate drivability of the hydraulic motors driving the individual conveyors and of the hydraulic motors driving the individual liquid pumps, it becomes possible also to scatter, with the three existing spreader devices, different thawing materials, namely liquid or solid materials, simultaneously, so that the spreader vehicle of the invention can be employed optimally in accordance with the existing conditions. This includes the possibility of covering narrower strips by using only some or only two spreading devices.

Since the conveyors accommodated in the laterally projecting feed pipes are provided with hydraulic motors, which are hydraulically connected in series with the hydraulic motor of the associated belt conveyor extending in lengthwise direction of the vehicle, not only is reliable functional safety with regard to the material transport from the vessel to the outer spreading devices ensured, but also it becomes easier to swing, as provided by the invention, the feed pipes from their laterally projecting crosswise position into a lengthwise position extending at least approximately parallel to the longitudinal axis of the vehicle.

In order to achieve equally good spreading properties for the liquid and for the solid thawing material both with respect to a homogeneous scatter density and with respect to achieving a large scatter angle to be maintained as accurately as possible or, respectively, a large scatter width to be maintained accurately, it is provided in a further development of the invention that the spreading devices, each comprising a distributing plate rotating about a vertical axis of rotation and equipped on its upper side with impellers, have two down pipes concentric with the axis of rotation which form separate feed passages for the thawing liquid and for the solid granulated thawing materials ending below the impeller plane and provided with radial outlet openings. The thawing liquid is supplied to the inner down pipe and the solid thawing materials to the outer down pipe.

Due to the fact that the distributor plate has two radially offset groups of impellers and that one group of impellers is arranged in an annular channel formed by the two down pipes while the other group of impellers is arranged radially outside the outer down pipe, the advantage of an additional improvement of the spreading properties in particular for the liquid thawing materials and the scattering of a thawing material mixture is achieved.

Advantageously the impellers of both groups consist of wall elements resting perpendicularly on the distributor plate top, the upper section of said wall elements being bent forward circularly in the direction of rotation over their entire length. Such impellers ensure a flat throw pattern and help avoid nebulization of the liquid thawing material.

To achieve intensive and homogeneous mixing when solid and liquid thawing materials are supplied simultaneously, a further development of the invention provides that the impellers arranged in the annular passage formed between the two down pipes have radial projection surfaces, and that the impellers disposed outside the outer down pipe have a lag angle to the radial plane of about 10° to 15°. In order to make it possible, if the distributor plate axis is arranged fixed inside the individual spreading device, to change the scatter direction, a further development of the invention provides that the end sections of the two down pipes, each of which is provided at the level of the impellers with a radial outlet opening, are rigidly connected together and are jointly adjustable about the axis of rotation of the distributor plate relative to the upper, fixed down pipe sections.

The different flow and centrifugal behavior of the solid and liquid thawing materials is taken into account by the fact that the outlet opening of the inner pipe carrying the thawing liquid extends over a larger sector angle of about 210° than the outlet opening of the outer pipe carrying the solid thawing materials, which extends over a sector angle of about 180°.

For the same purpose, it is advantageous if the two outlet openings of the inner and outer down pipes are offset to each other in the circumferential direction in such a way that the axial limiting edge of the outlet of the outer pipe lying in front in the direction of rotation of the distributor plate, viewed in the direction of rotation of the distributor plate, lies about 45° ahead of the front axial limiting edge of the outlet of the inner pipe.

To obtain good and rapid flow of the thawing liquid through the inner pipe onto the distributor plate, the plate is provided with a truncated cone protruding into the inner pipe from below.

The invention is further characterized by the fact that for the selective scattering of thawing liquid or solid thawing material or for the selective simultaneous scattering of liquid and solid material through the same device in quantities regulated in proportion to the speed of travel and corresponding to a preselectable density and adjustable width, there are provided—for the control of the hydraulic motors of the conveyors assigned to the three control devices and of the hydraulic motors of the pumps which supply the spreading devices with thawing liquid—three hydraulic control units, each assigned to one of the spreading devices and each consisting of two electromagnetic valves to be operated electrically either separately or jointly. These control units connect, in their inoperative states, the pressure line of a hydraulic motor of a conveyor and the pressure line of the hydraulic motor of a liquid pump with a return line of the hydraulic fluid. The advantage of this measure is in particular the simplicity as well as the low cost and the reliable functional safety of the control device, permitting four different stable control states to be achieve with only two electromagnetic valves.

A very simple and easy-to-follow operation can be achieved by the fact that the hydraulic control units are each equipped with a switching unit comprising three electric closing switches connected in parallel with one another, one closing switch being connected directly in the circuit of each of the electromagnetic valves and the third closing switch being inserted via diodes in a circuit of each of the two electromagnetic valves.

By a further measure, which is important in particular when thawing materials having different dew points are scattered simultaneously, when the thawing liquid consists for example of $CaCl_2$ and the solid thawing material of potash salt, the economic efficiency of the respective spreading operation can be substantially increased by arranging that the third closing switch lies at the same time in the circuit of an electromagnetic change gear which, for simultaneous scattering of solid and liquid thawing materials by the same spreading device, brings about a reduction of the driving-speed-dependent rate of rotation of a tachogenerator which regulates the speed of the conveyors. Such a device is known per se through German Pat. No. 2632 794; it has, however, been employed until now only in a salt spreader with wetting device.

The invention further provides that the pressure lines of the hydraulic motors driving the conveyors and liquid pumps are connected on the exit side to a triple flow divider whose entrance is connected with a driving-speed-dependently controlled electric proportional valve in communication with a pressure medium pump, and that the pressure lines of the hydraulic motors driving the three distributor plates are connected on the exit side to a triple flow divider whose entrance is connected to a manually settable proportional valve connected with a second pressure medium pump. By this measure it is possible to obtain stable, unambiguously defined control and operating conditions as well as a high functional safety at lowest possible cost.

BRIEF DESCRIPTION OF THE DRAWINGS

In the following, an embodiment of the invention is explained more specifically with reference to the drawings, in which.

DESCRIPTION OF THE PREFERRED EMBODIMENT

Figure 1:
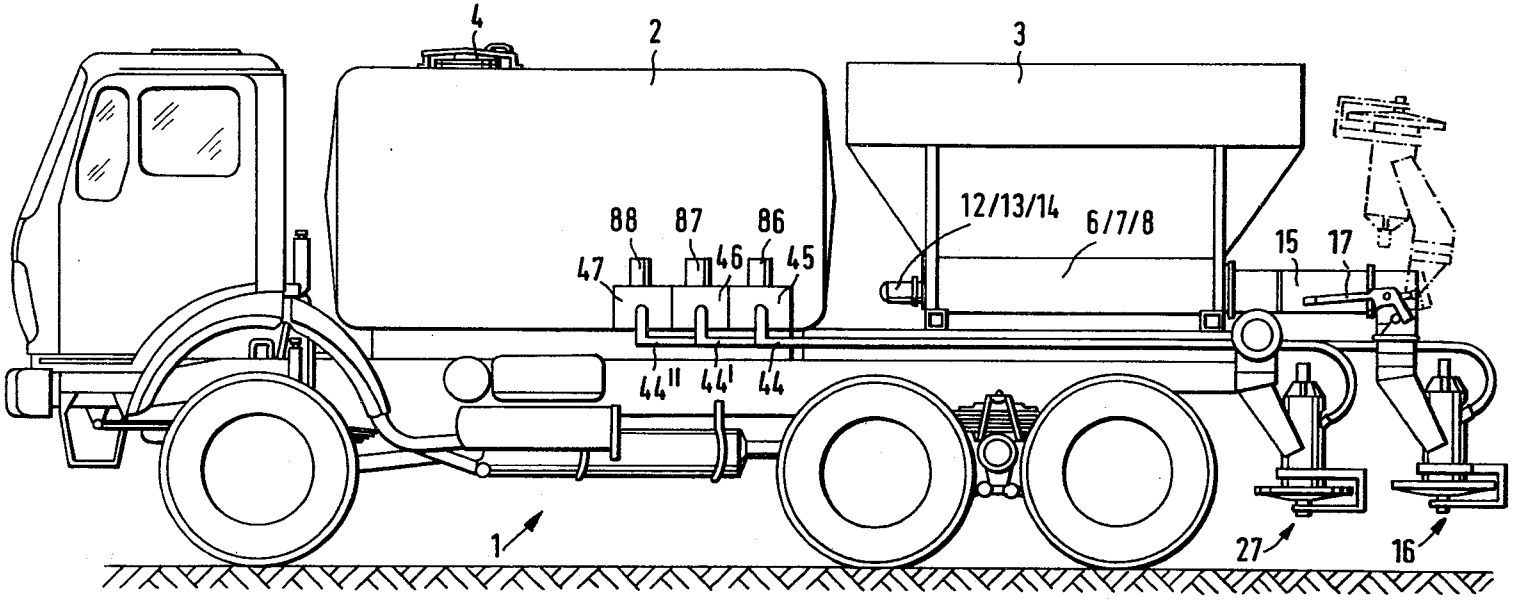
FIG. 1 is a side elevational view of a spreader vehicle.
Figure 2:
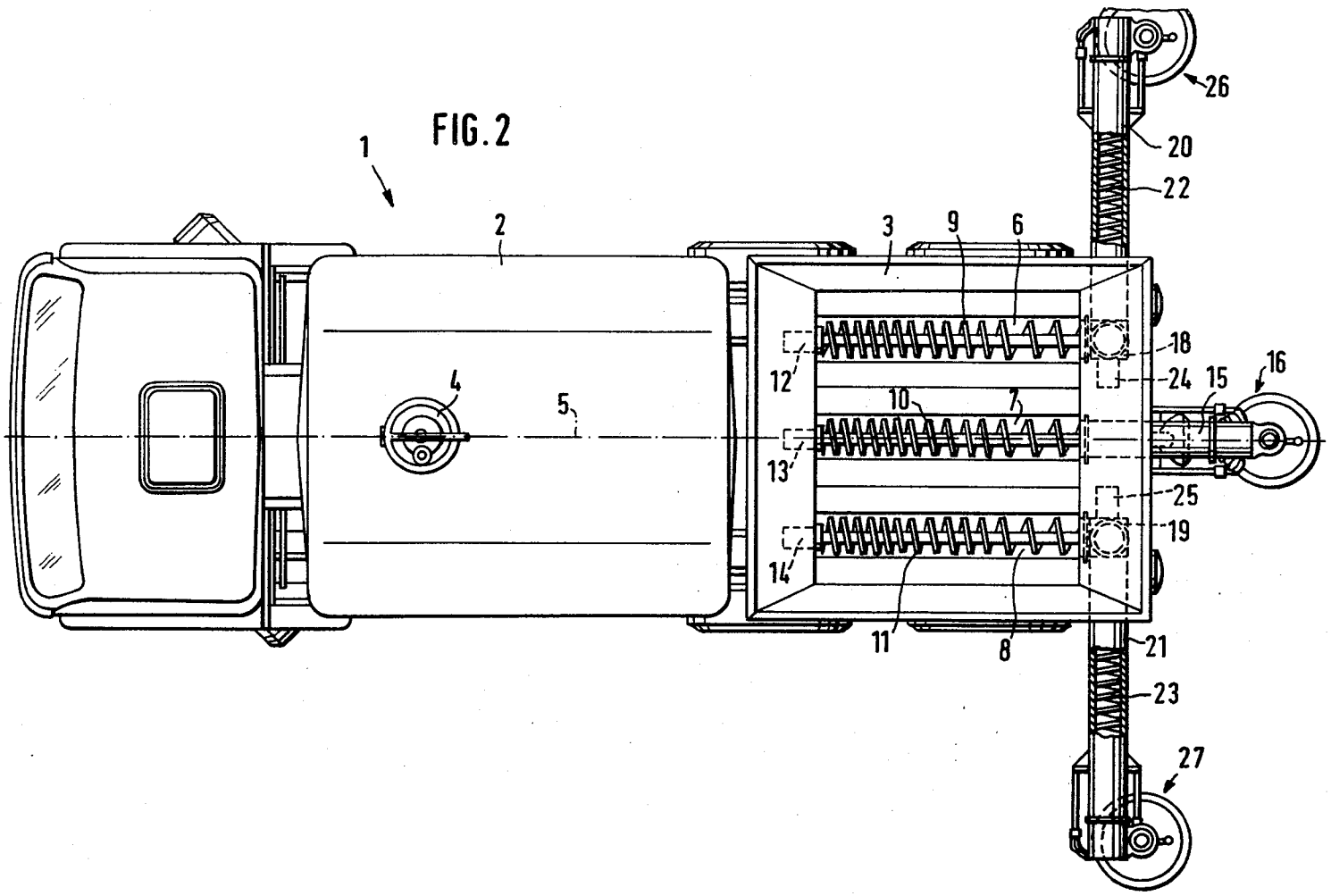
FIG. 2 is a top plan view of the spreader vehicle of FIG. 1.
Figure 3:
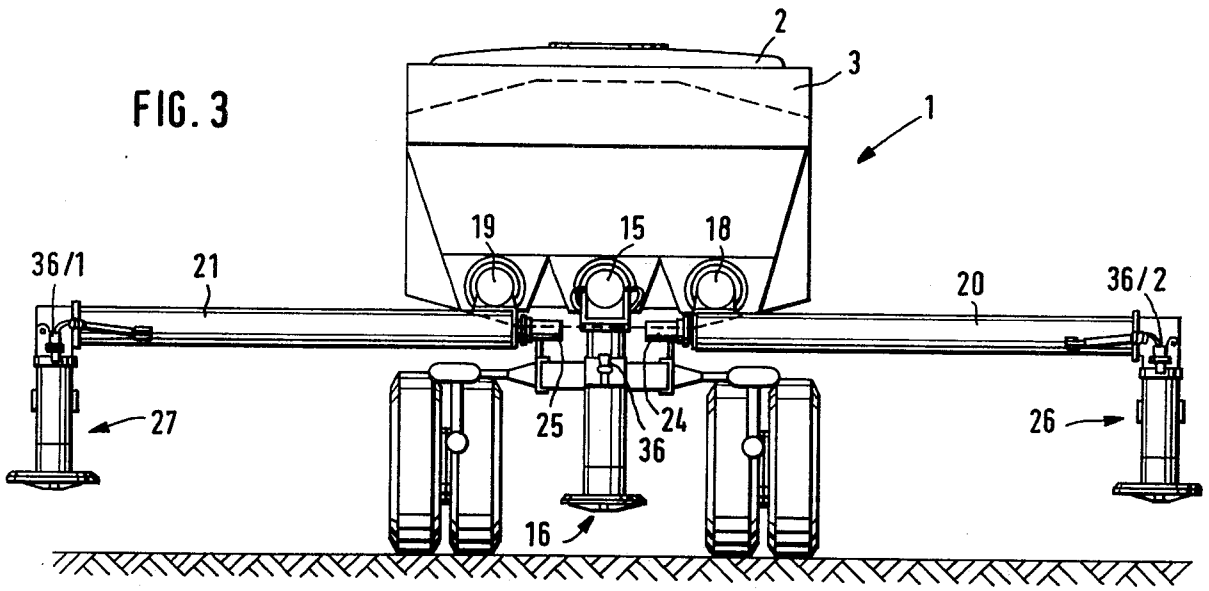
FIG. 3 is a rear elevational view of the spreader vehicle of FIGS. 1 and 2.

Referring to the drawings, the invention shown therein, FIGS. 1, 2 and 3 is a spreader vehicle gneerally designated 1, with vessels 2 and 3 arranged one behind the other. Vessel 2 consists of a closed barrel provided with a filling aperture 4 and serves to carry liquid thawing material, e.g. calcium chloride solution ($CaCl_2$). Vessel 3 is formed as a box which is open at the top and has partially slanting walls which passes in its lower region three feed troughs 6,7 and 8 lying side by side and extending parallel to the longitudinal median axis 5 of the vehicle and in which are carried solid granulated thawing materials, e.g. potash salt. In the feed troughs 6, 7 and 8 are conveyors 9, 10 and 11 in the form of conveyor worms or screws, which are driven by a hydraulic motor 12,13 and 14 in such a way that the scatter material contained in the feed troughs 6, 7 and 8 is discharged from the vessel rearwardly. Connected to the central feed trough 7, as customary in the known spreaders, is a horizontal feed pipe 15 prolonging the feed trough 7, at the rear end of which a spreading device 16 is located, which will be described more fully later on. As can be seen from FIG. 1, the spreading device 16 is attached at the rear end of feed pipe 15 so as to extend crosswise to the longitudinal vehicle axis 5, so that during the trips to the site of use, the spreading device can be swung into the position shown in dash-dot lines and locked therein. The fixation of the spreading device 16 in the lower operating position and in the swung-up inoperative position can be secured by a manually operable latch 17 or, as is known in itself, by means of a pneumatic spring disposed in the form of a toggle joint.

The two outer feed troughs 6 and 8 discharge into extension pipes 18 and 19 which are disposed outside the rear endwall of vessel 3 and which communicate in turn with feed pipes 20 and 21 projecting outwardly at right angles to the longitudinal vehicle axis 5. The feed pipes 20 and 21 are disposed in a plane lying below the extension pipes 18 and 19 and are pivotably connected with them in such a way that they can be swung forward out of the position shown in FIG. 2 and 3, so that they can occupy a position approximately parallel to the axis 5 during trips of the spreader vehicle 1 to the sites of use. In the feed pipes 20 and 21 conveyors 22, 23 are arranged, which also consist of conveyor worms and are drivable by hydraulic motors 24, 25. At the outer ends of the feed pipes 20 and 21, spreading devices 26, 27 are arranged which in design and mode of operation correspond to the spreader device 16 and likewise can be swung upwardly. The pivot axes of the spreading devices 26 and 27 coincide with the axes of symmetry of the feed pipes 20, 21.

Figure 4:
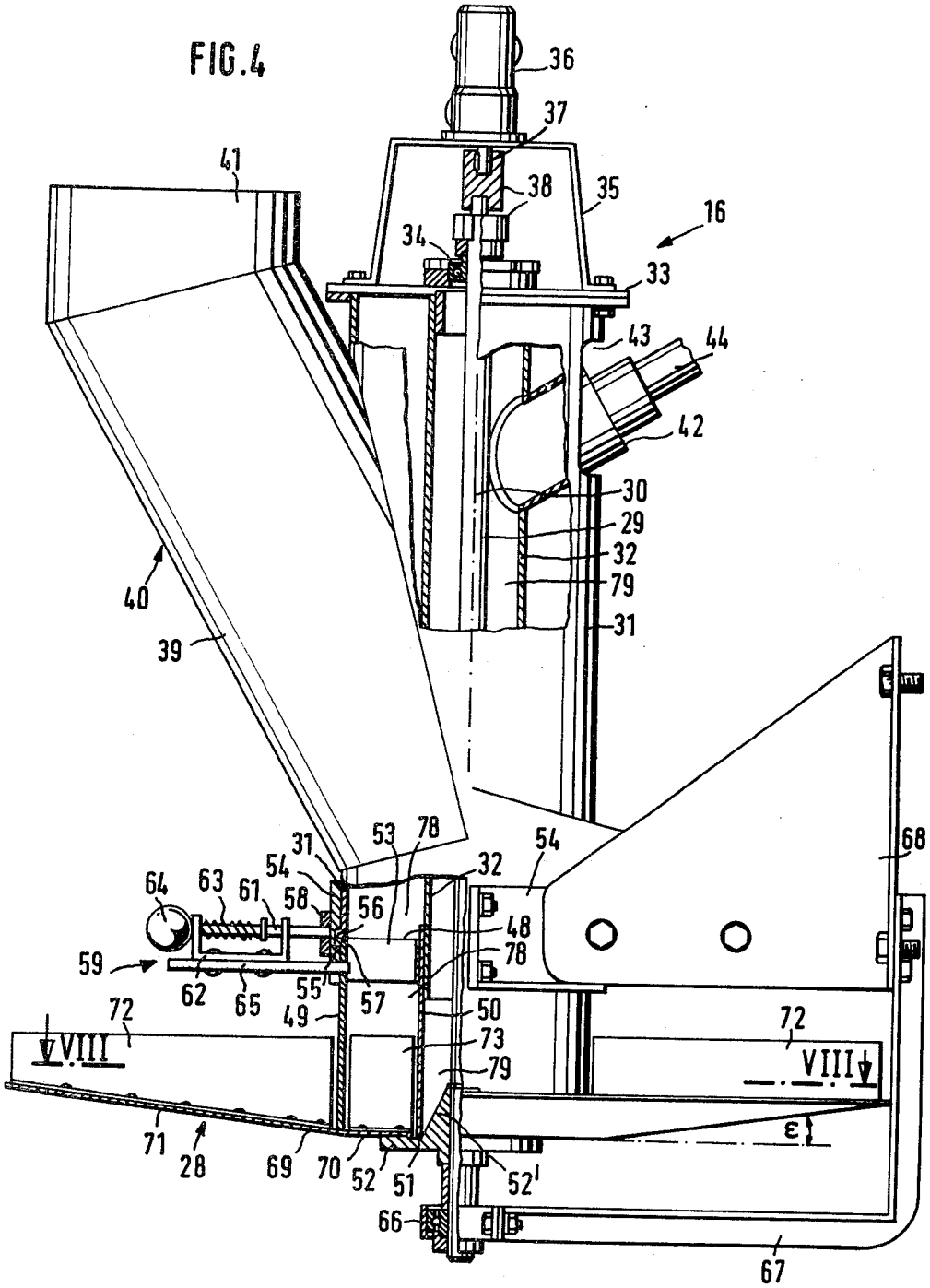
FIG. 4 is a partially sectional side view of a spreader device.
Figure 5:
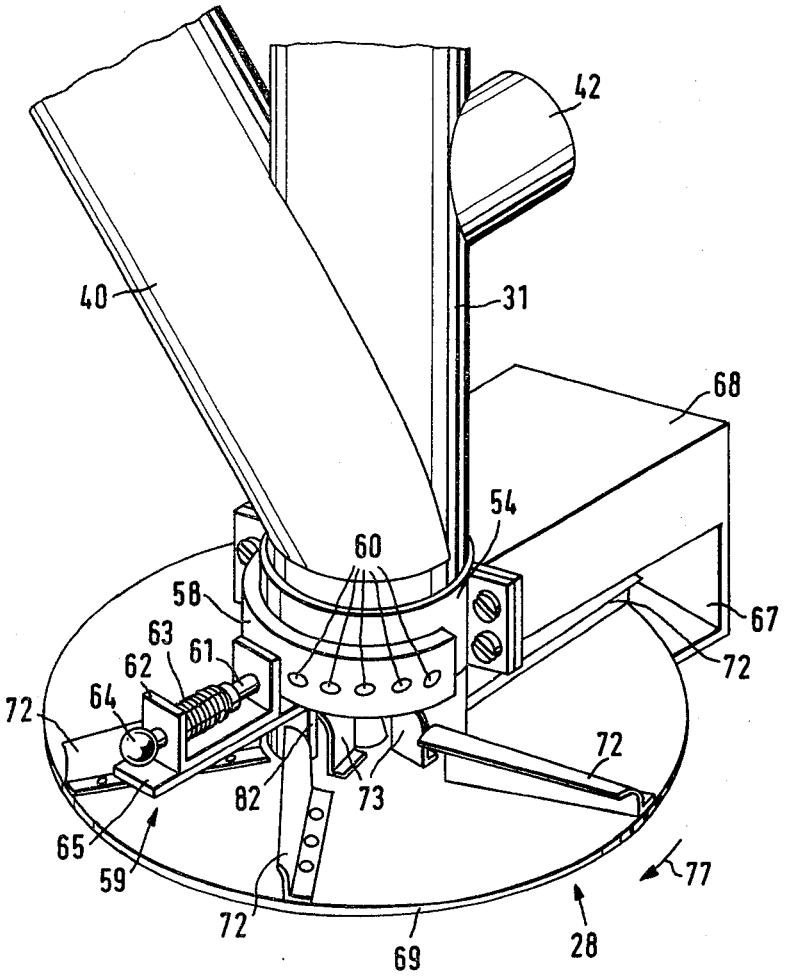
FIG. 5 is a perspective top view of a spreader device.

Referring now to FIG. 4, the design and mode of operation of the spreading devices 16 as well as 26 and 27 will be described in greater detail. The spreading device 16 shown in FIGS. 4 and 5 comprises a distributor plate 28 serving as impeller, which is secured to the lower end of a vertical shaft 29. Concentric to the axis of rotation 30 of shaft 29, two down pipes 31 and 32 are arranged, the diameter of the inner pipe 32 being about half as large as the diameter of the outer pipe 31. The two down pipes 31 and 32 end at their upper end in the same plane and are provided with a common cover 33 by which they are connected together and on which the upper bearing 34 of shaft 29 is arranged. A yoke 35 is screwed to cover 33, on which a hydraulic motor 36 is mounted, whose shaft end 37 is in non-rotational connection with shaft 29 by a coupling 38. Welded laterally to the outer down pipe 31 is an obliquely extending section 39 of a guide pipe 40, whose vertical section 41 is connected with a lower outlet opening of feed pipe 15, so that the granulated thawing material transported by conveyor 10 through feed pipe 15 passes through the guide pipe 40 into the annular feed channel or passage 78, between the inner and outer down pipes 31,32. The inner guide pipe 32 is provided with a radial pipe piece 42 directed obliquely upward which extends outwardly through an opening 43 of the outer down pipe 31 and which is connected to a liquid line 44. Line 44 is connected with the unit of a liquid pump 45 which can deliver thawing liquid from vessel 2 into down pipe 32. The guide pipes 40 of the two spreading devices 26 and 27 are pivotably connected with the feed pipes 20, 21, in such a way that they can be supplied by the conveyors 9 and 11 or respectively 22 and 23, with solid thawing material in a manner still to be described. For the liquid lines 44' and 44" connected to the inner down pipes 32 of the spreading device 26 and 27 separate liquid pumps 46 and 47 are provided, which likewise can separately convey thawing liquid from vessel 2 into the inner down pipes 32 of the spreading devices 26 and 27. The down pipes 31 and 32 are separated in a horizontal plane 48 lying above the distributor plate 28, or extended by lower end sections 49 and 50 respectively to the upper distributor plate face. The lower end section 49 of the outer down pipe 31 ends just above the surface of the distributor plate 28 and the lower end section 50 of the inner down pipe 32 protrudes into an annular groove 51 of a flanged hub 52 by which the distributor plate 28 is nonrotationally connected with shaft 29. The flanged hub 52 is provided with a truncated conical shoulder 52' which protrudes into the lower end section 50 of the inner down pipe 32. The two lower end sections 49 and 50 are firmly connected together by radial, plate like webs 53 and are jointly rotatable relative to the down pipes 31 and 32 and their common axis coincident with the axis of rotation 30. The connection between the lower end sections 49 and 50 and the down pipe 31 is established by a shackle like cuff 54 with an inner annular groove 55, by which two flanged rings 56 and 57 disposed at the lower end of the outer down pipe 31 and at the upper end of the lower section 49 are held together.

On the outside of cuff 54 a perforation strip 58 is fastened which extends over an angle of about 180° and which is part of a locking device 59 for fixing the two end sections 49 and 50 in certain angular positions. The locking device comprises a pin 61 fitting into the holes 60 of the perforation strip 58, the pin being displaceable in a U-shaped yoke 62 and provided with a compression spring 63 and pull knob 64. The yoke 62 is mounted on a horizontal plate 65 which is secured to the lower end section 49 of the outer down pipe 31.

The lower end of shaft 29 has a bearing 66 which is held by a yoke 67 spanning the distributor plate radius. Yoke 67 in turn is connected with cuff 54 by a radial connection piece 68.

Figure 6:
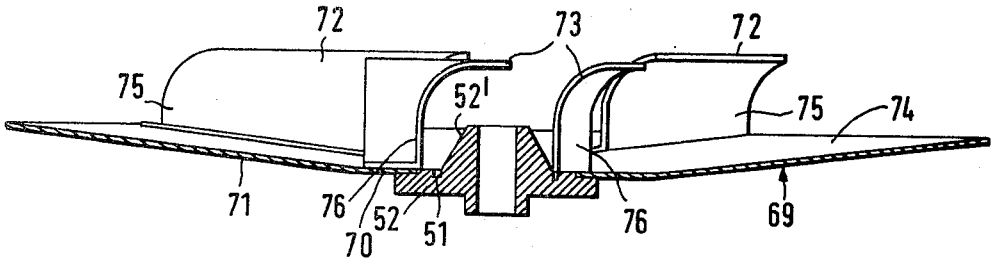
FIG. 6 is a sectional view of a distributor plate.
Figure 7:
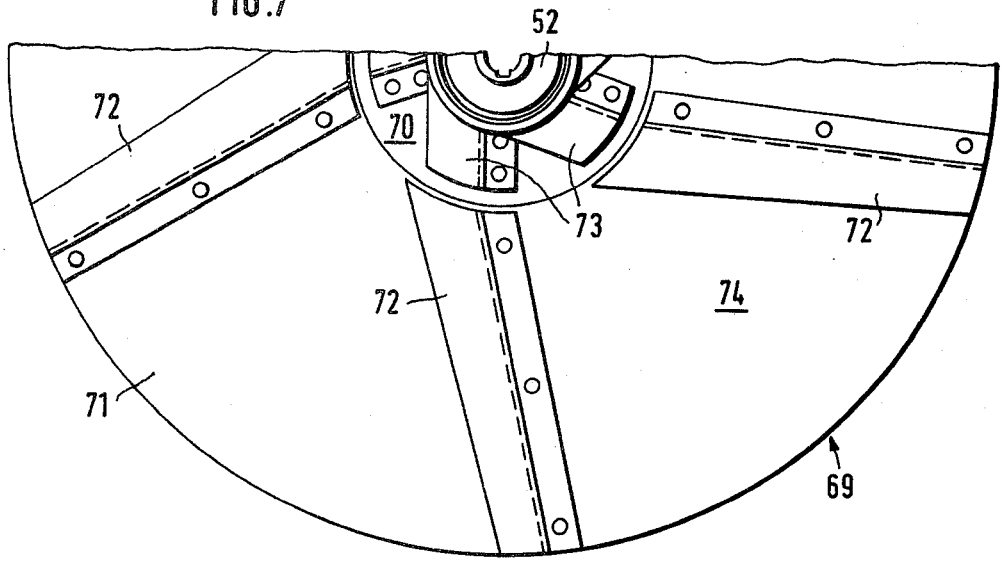
FIG. 7 is a top plan view of one half of a distributor plate half.
Figure 8:
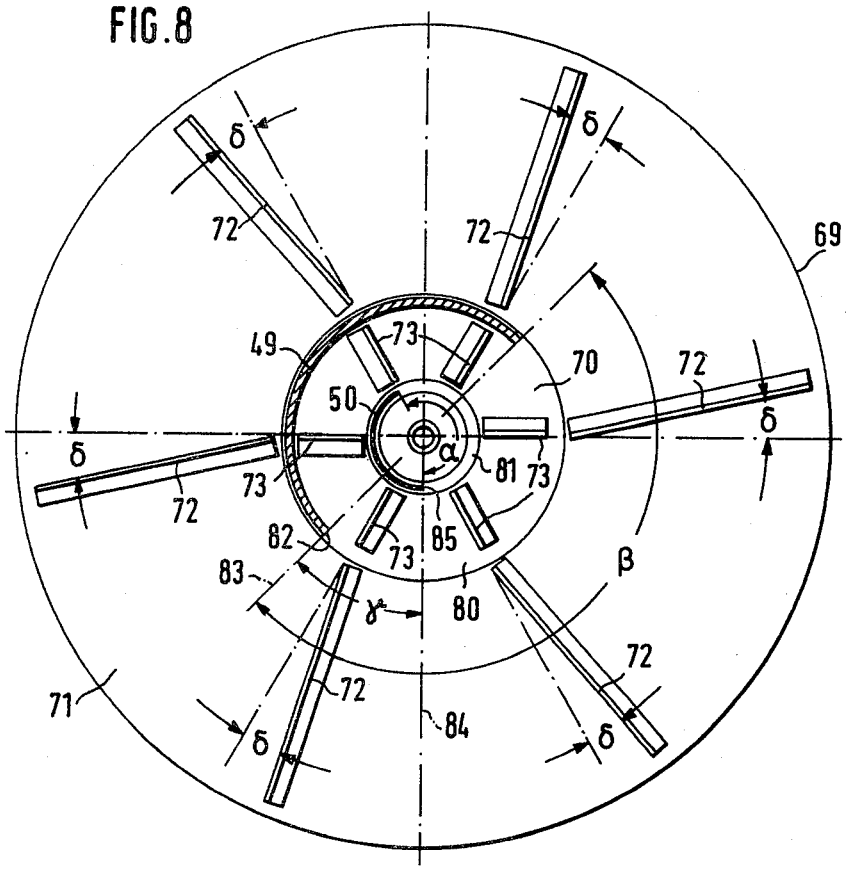
FIG. 8 is a sect taken along line VIII—VIII from FIG. 4.

The distributor plate 28 consists of a circular disk 69, which at the center has a flat annular portion 70 approximately corresponding to the diameter of the outer down pipe 31 and whose outer annular portion 71 forms with the horizontal plane of the inner annular portion 70 a taper angle epsilon of about 7°. On the top side of disk 69 two groups of six impellers 72 and 73 are arranged, each consisting of a wall element 75, 76 mounted perpendicularly on the disk surface 74, the upper part of which is bent forwardly into approximately a horizontal plane in the direction of rotation of the distributor plate 28, which is indicated by the arrows 77. The profile of these impellers 72 and 73 can best be seen from FIG. 6. The group of impellers 72 is disposed outside the outer down pipe 31 on the surface 74 of disk 69. The group of impellers 73 much shorter in radial direction is disposed in the annular passage 78 between the inner down pipe 32 and the outer down pipe 31, namely so that the wall elements 76 forming them extend at least approximately radially. The outer impellers 72, instead have relative to the respective polar vector on which the respective inner impeller 73 is mounted a lag angle delta, as can be seen from FIG. 8. Lag angle means that seen in direction of rotation of arrow 77 the outer ends of impellers 72 are set back relative to their inner ends.

Figure 9:
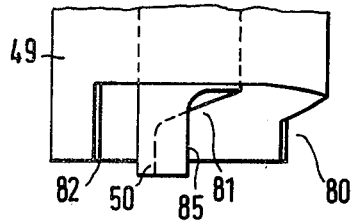
FIG. 9 is a side elevational view of the outlet openings of the down pipes.

By the two concentrically arranged down pipes 31 and 32 there are formed in the spreading device 16 and likewise in the spreading devices 26 and 27 two separate feed channels for the solid and for the liquid thawing materials. One feed channel 78 has been mentioned before. It is present as an annular channel between the inner down pipe 32 and the outer down pipe 31. The second feed channel 79 is formed by the interior of the inner down pipe 32, through which extends the shaft 29. Through this feed channel 79 the liquid thawing materials are supplied to the distributor plate 28. In order that the supplied solid and liquid thawing materials can issue from the supply channels in radial direction and be hurled out by the distributor plate 28, the two lower sections 49 and 50 of the two down pipes 31 and 32 are provided at the level of the impellers 72 and 73 with outlet openings 80 and 81 (see FIGS. 5, 8 and 9), which are of unequal size over the periphery. The outlet 80 of the lower section 49 of the outer down pipe 31 extends over a sector angle beta of about 180°. The outlet 81 of the lower section 50 of the inner down pipe 32 extends over a sector angle alpha of about 210° and hence is about 30° larger than the outlet opening 80. Besides, the two outlet openings 80 and 81 are offset relative to each other in circumferential direction in such a way that the axial limiting edge 82 lying in front in the direction of rotation of the distributor plate 28 indicated by arrow 77 lies on a polar vector 83, which has an angular distance gamma of about 45° from the polar vector 84 on which lies the preceding axial limiting edge 85 of outlet opening 81.

Because the two lower end sections 49 and 50 of the two down pipes 31 and 32 rotate jointly, the two outlet openings 80 and 81 can be adjusted jointly about the axis of rotation 30 by means of the locking device 59. This then results in a change of the spreading direction of the individual spreading devices 16, 26 or 27.

As mentioned before, the conveyors 9, 10 and 11 as well as 22 and 23 are driven by separate hydraulic motors 12, 13,14 and 24 and 25 respectively. To achieve constant scatter densities even at different travel speeds of the spreader vehicle 1, it is known to be necessary to regulate the drive speeds of the belt conveyors 9, 10 and 11 or 22 and 23 respectively and hence the hydraulic motors 12,13 and 14 or 24 and 25 respectively as a function of the travel speed.

Also the pumps 44, 45 and 46 conveying the thawing liquid from vessel 2 to the individual spreading devices 16, 26 and 27 are individually driven by hydraulic motors 86, 87 and 88 and regulated as a function of the travel speed. In addition, the hydraulic motors 12,13,14 as well as 86,87 and 88 are to be adapted to be turned on and off separately.

Figure 10:
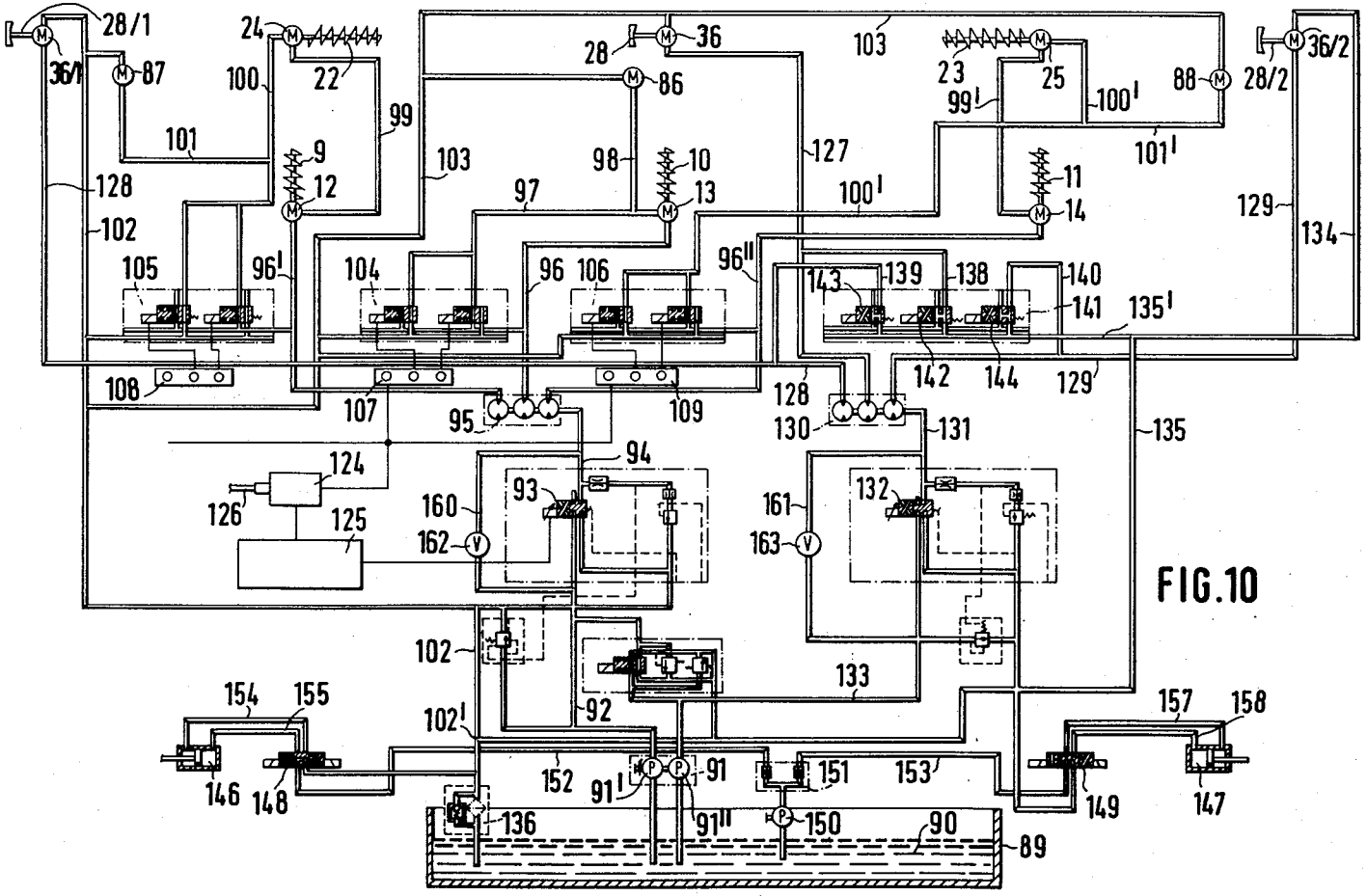
FIG. 10 is a circuit diagram of the hydraulic control and drive arrangement.

For this purpose a hydraulic control and drive device shown schematically in FIG. 10 is provided, which will be explained in greater detail below.

Figure 11:
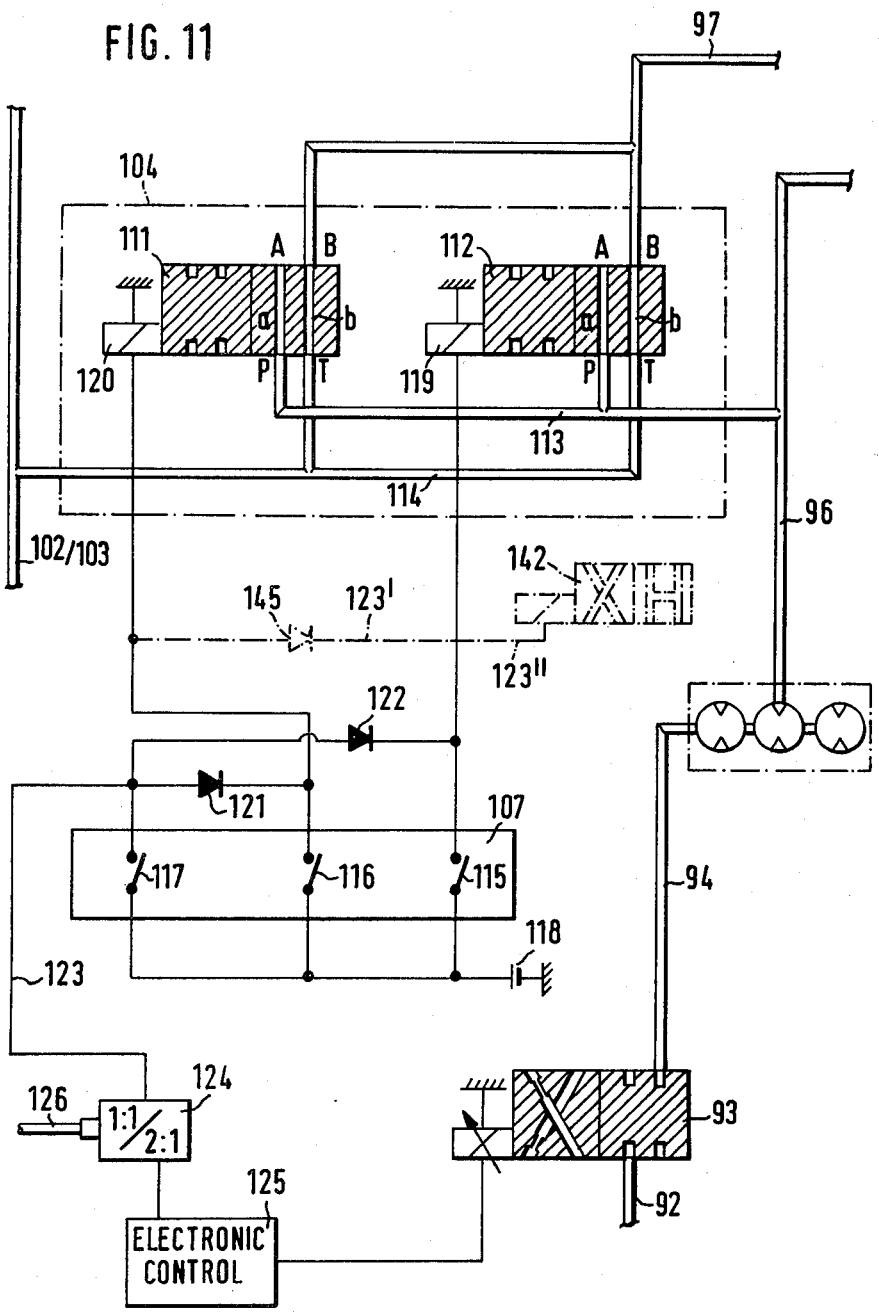
FIG. 11 is a circuit diagram of a contr-l unit with electric switching unit of the control and drive arrangement from FIG. 10.

A tank 89 contains a hydraulic pressure fluid 90, with which the entire control and drive system is fed by a double pump 91. One unit 91' of the double pump 91 serves to supply the hydraulic pumps 12,13,14,24,25 as well as 86,87 and 88, while unit 91'' serves to supply those of the distributor plates 28, 28/1 and 28/2 of the individual spreading devices 16, 26 and 27. The pressure line 92 of pump unit 91 is connected with the entrance of an electromagnetic proportional valve 93, whose exit is connected by a line 94 with the entrance of a triple flow divider 95. The central exit of the flow divider 95 is connected by a pressure line 96 with the hydraulic motor 13, the return line 97 of which has a branch line 98 to the hydraulic motor 86 of the liquid pump 45. In a analogous manner the two other exits of the flow divider 95 are connected by pressure lines 96' and 96'' on the entrance side with the hydraulic motor 12 or 14, respectively. The hydraulic motor 12 is connected in series by a connecting line 99 the hydraulic motor 24 of to the conveyor 22, and the hydraulic motor 14 is connected in series by a connecting line 99' to the hydraulic motor 25 of the conveyor 23. To the return line 100 of the hydraulic motor 24 there is connected by a branch line 101 the hydraulic motor 87 of the liquid pump 46, the exit of which is connected with a return manifold 102. The return line 100' of the hydraulic motor 25 is connected by a branchline 101' with the hydraulic motor 88 of the liquid pump 47, the exit of which communicates by a return line 103 with the return manifold 102. The return line 103 is connected also to the exit of hydraulic motor 86. For the selective individual or joint switching on of the hydraulic motors 13 and 86, or 12, 24 and 87 respectively or 14, 25 and 88 (jointly assigned to a spreader device 16 or 26 or 27) there are provided identically designed or identically operating or identically actuated control units 104, 105 and 106, which can be actuated electrically by means of separate switching units 107, 108 and 109. Such a control unit is shown in FIG. 11. Each of these control units 104, 105 and 106 consists of two electromagnetic valves 111 and 112, each having two separate passage channels a and b, whose terminals are marked A, B, P and T. The return line 97 of the hydraulic motor 13 is connected on the one hand with the terminal A of the electromagnetic valve 112 and at the same time, on the other hand, with the terminal B of electromagnetic valve 111. The opposite terminal P of electromagnetic valve 112 and the corresponding terminal P of the electromagnetic valve 111 are connected by a branch line 113 with the pressure line 96, while the two terminals T of electromagnetic valve 112 on the one hand and of the electromagnetic valve 111 on the other are connected by a line 114 with the return line 102/103.

The electric switching unit 107, which serves to actuate the two electromagnetic valves 111 and 112, has three electric closing switches 115, 116 and 117. Switch 115 is in series with the current source 118 directly in the circuit of the electromagnet 119 of valve 112. Analogously switch 116 lies directly in the circuit of the electromagnet 120 of valve 111, while switch 117 lies simultaneously in both circuits of the electromagnets 119 and 120 via diodes 121 and 122 which are to prevent a cross connection. The closing switch 117 is connected at the same time by an electric line 123 to an electromagnetic change gear 124 which serves as pulse transmitter for an electronic control 125 and is connected to the tachometer shaft 126 of the vehicle. When switch 117 is open, the change gear 124, serving at the same time as tachogenerator, delivers to the electronic control 125 a certain number of pulses or a voltage corresponding to the speed per revolution of the tachometer shaft 126. When switch 117 is closed, there occurs in the change gear a speed reduction, e.g. in the ratio 2:1 , so that only half the number of pulses per revolution of the tachometer shaft 26 or half the voltage for the same speed of rotation of shaft 126 is delivered to the control electronic 125. The control electronic 125 in turn controls the proportional valve 93 in such a way that quantities of pressure medium corresponding to the respective initial speed of the change gear 124 get to the flow divider 95, owing to which the conveyors 9, 10 and 11 or 22 and 23 respectively as well as the liquid pumps 45,46 and 47, are driven in proportion to the speed of travel.

The control unit 104 and hence also the control units 105 and 106 operate as follows:

If none of the switches 115, 116 and 117 is closed and hence the electromagnets 119 and 120 are not excited, the electromagnetic valves 111 and 112 are in a state in which channel b of the electromagnetic valve 111 and channel a of electromagnetic valve 112 have passage, which means that the pressure line 96 is connected via the two magnetic valves 111 and 112 directly with the return line 102/103 and cannot cause drive of hydraulic motor 13 or of hydraulic motor 86.

If switch 115 is closed, channel a of valve 112 is closed, so that now only the return line 97 of hydraulic motor 13 is connected via channel b of valve 111 with the return line 102/103, and hence the hydraulic motor 13 is driven. In the analogous state of the two switching units 105 and 106 not only the hydraulic motors 12 and 14 but also the hydraulic motors 24 and 25 in series with them are driven, as their return lines 100, 100' are connected with the return line 102 via the electromagnetic valves 111.

If only switch 116 is closed, and if electromagnetic valve 111 is switched, channel b of this valve is closed, so that the pressure fluid arriving from line 96 passes through channel a of valve 112 and the line 97 now becoming the pressure line and the connecting line 98 directly to the hydraulic motor 86 and drives only the latter, while hydraulic motor 13 stands still. This means that in this case only thawing liquid is conveyed to the respective spreading device, while in the preceding case, where only switch 115 was closed, through the hydraulic motor 13 and the conveyor 10 exclusively solid thawing material was supplied from vessel 3 to the spreading device 16.

If with switches 115 and 116 open only switch 117 is closed, both electromagnetic valves 111 and 112 are excited simultaneously, with the result that all channels a and b of both electromagnetic valves are shut and line 97 is blocked. The pressure fluid supplied through line 96 can thus flow through the hydraulic motor 13 and hydraulic motor 86 only successively and drive them jointly. With switch 117 closed, therefore, liquid and solid thawing material is supplied to the respective spreading means simultaneously, in quantities proportional to the speed of travel. In analogous manner also the hydraulic motors 12, 24 and 87 or 14, 25 and 88 can be energized simultaneously, which are assigned to the spreading devices 26, 27.

The hydraulic motors 36, 36/1 and 36/2, which each by itself drive the distributor plates 28, 28/1, 28/2 of the three spreading devices 16, 26 and 27, are each connected by pressure lines 127, 128, 129 with an exit of a second triple flow divider 130, the entrance of which communicates by a common pressure line 131 via an electromagnetic proportional valve 132. Valve 132 is controlled voltage-proportionally by means of an electric control means not shown in the drawing but known per se, in such a way that it is settable to different pressure medium passage quantities per unit of time, corresponding to very specific speeds of rotation of the hydraulic motors 36, 36/1 and 36/2 as well as of their distributor plates 29, 28/1, 28/2.

The exit of hydraulic motor 36 is connected with the return line 103. The exit of hydraulic motor 36/1 is connected with the return manifold 102, and the exit of hydraulic motor 36/2 is connected by a return line 134 with an additional return manifold 135 which discharges at point 102' into the return manifold 102, which ends via a sieve device 136 in the pressure medium tank 89.

For the individual actuation of the hydraulic motors 36, 36/1 and 36/2 there are connected to the individual pressure lines 127, 128 and 129 shunt lines 138, 139, 140 which, via three individually controllable electromagnetic valves forming a control block 141, are each connected separately to a common return line 135, discharging into the return manifold 135.

For the electric activation of these electromagnetic valves 142, 143 and 144, the switching units 107, 108 and 109 can be made use of too, because it is to be assured that the distributor plates 28, 28/1, 28/2 are set in rotation also when solid and/or liquid thawing material is supplied to them by the conveyors 10, 12 and 22 or respectively 11 and 23 and/or by the liquid pumps 45, 46 or 47 driven by the hydraulic motors 86, 87, 88. For this purpose the switching unit 107 or 108 or 109 can be actuated electrically by lines 123' and 123'', shown in dash-dot lines, of the electromagnets 142, 143, 144. In line 123' which connects the two lines leading from the switches 115, 116 to the electromagnets 119 and 120, a diode 145 is inserted, to prevent cross currents. In the same way also the electromagnets 143 and 144 can be actuated by the switching units 108 and 109.

If the electromagnets 142, 143 and 144 are not excited, there exists via the shunt lines 138, 139 and 140 a direct connection between the pressure lines 127, 128 and 129 on the one hand and the return line 135' on the other, so that the hydraulic motors 36, 36/1 and 36/2 are not driven. If, however, for example by closing one of the switches 115, 116 or 117, one of the three switching units 107, 108 or 109 of one of the electromagnetic valves 142, 143 or 144 is excited, the respective shunt connection is interrupted and pressure medium fluid is supplied to the respective hydraulic motor 36 or 36/1 or 36/2 and the hydraulic motor 36 or 36/1 or 36/2 connected thereto is set in rotation together with its distributor plate 28 or 28/1 or 28/2.

To swing the two feed pieces 20 and 21 from the position shown in FIGS. 2 and 3, in which they extend outward at right angles to the longitudinal vehicle axis 5, into an inoperative or transport position approximately parallel to said axis, or vice versa, hydraulic double-action cylinders 146 and 147 may be provided (see FIG. 10) which by means of electromagnetic switching valves 148, 149 can be pressurized jointly in one or the other direction. To this end an additional pressure medium pump 150 is provided, the exit of each of which is connected via a flow divider 151 and via two pressure lines 152 and 153 with one of the two switching valves 148, 149, the exits of which are connected by two lines 154, 156 or respectively 157 and 158 with one of the two pressure chambers of the two double-action cylinders 146, 147 lying on either side of the piston.

Shunt lines 160, 161 are assigned to the two proportional valves 93 and 132, in which manually operable valves 162, 163 are located. They are used, with the vehicle standing, to set all hydraulic motors of the system in motion singly or jointly, for example to empty the vessels 2 and 3.

Normally such hydraulic control systems are further equipped with safety devices, the description of which can be dispensed with here, however, as they have no influence on the dscribed mode of operation of the entire hydraulic system during normal operation.

While specific embodiments of the invention have been shown and described in detail to illustrate the application of the principles of the invention, it will be understood that the invention may be embodied otherwise without departing from such principles.

I claim:

1. A spreader device comprising a frame a distributor plate mounted for rotation about a vertical axis on said frame, drive means connected to said distributor plate for rotating said distributor plate, said distributor plate including on a top surface thereof, a plurality of impellers, an inner downpipe concentrically positioned about said vertical axis and defining a liquid supply conduit for supplying a liquid thawing material to said distributor plate, an outer downpipe positioned concentrically around said inner downpipe positioned concentrically around said inner downpipe defining an annular space therewith acting as a granulated material supply conduit for supplying granulated thawing material to said distributor plate.

2. A spreader, according to claim 1, wherein said impellers include a first plurality of impellers positioned in said annular space between said inner and outer downpipes, and a second plurality of impellers positioned radially outwardly of said first plurality of impellers and outwardly of said outer downpipe.

3. A spreader according to claim 2, wherein said distributor plate of each distributor means is rotated in an impelling direction, each impeller including a wall portion extending substantially perpendicular to a plane of said distributor plate and an upper portion curved forwardly toward the impelling direction across the entire radial length of each impeller.

4. A spreader according to claim 3, wherein said first plurality of impellers extends substantially radially of said vertical axis and said second plurality of impellers extend at an acute angle to the radial direction from said vertical axis with the radially outer end of each second impeller lagging behind a radially inner end of each impeller in said impelling direction.

5. A spreader according to claim 4, wherein said acute angle is between about 10° and 15°.

6. A spreader according to claim 5, wherein each radially inner end of said second impellers are at the radial position of a corresponding one of said first impellers.

7. A spreader according to claim 6, wherein said inner and outer downpipes each include a lower section extending vertically in the vicinity of said impellers having an arcuately extending opening for the discharge of granulated and liquid material onto said distributor plate, said arcuate extending opening of said inner and outer downpipe lower sections being fixed in position with respect to each other, each lower section being rotatably mounted about said vertical axis with respect to a remainder of said inner and outer downpipes.

8. A spreader according to claim 7, wherein the arcuately extending opening of said inner downpipe lower section extends through a greater arc than the arcuately extending opening of said outer downpipe lower section.

9. A spreader according to claim 8, wherein the arcuately extending opening of said inner outer downpipe lower section extends about 210° around said vertical axis and said arcuately extending opening of said outer downpipe lower section extends for about 180° of arc around said vertical axis.

10. A spreader according to claim 7, wherein a downstream edge of the arcuately extending opening of said inner downpipe lower section, in said impeller direction, is offset by an acute angle upstream of the upstream edge of the arcuately extending opening of said outer downpipe lower section.

11. A spreader according to claim 10, wherein said acute offset angle between said arcuately extending opening is about 45°.

12. A spreader according to claim 1, wherein said distributor plate includes a truncated conical member extending upwardly from a plane of said distributor plate and into the space defined by said inner downpipe.

13. A spreader of granulated and liquid thawing material for a vehicle having a longitudinal axis comprising:

a granulated material vessel on the vehicle having a plurality of feed troughs each having a granulated material outlet;

a conveyor in each trough for conveying granulated material to a respective granulated material outlet;
a hydraulic motor connected to each conveyor;
a liquid material vessel on the vehicle;
distributor means connected to the vehicle and each feed trough outlet;
each distributor means including a rotatable distributor plate, a hydraulic motor connected to each distributor plate, a granulated material conduit connected to a respective feed trough outlet for supplying granulated material to said distributor plate, and a liquid material conduit for supplying liquid material to said distributor plate, said granulated and liquid material conduits structured to maintain a separation of liquid and granulated material up until the vicinity of said distributor plate;
a liquid supply line connected from said liquid material vessel to each liquid material conduit;
a liquid pump in each supply line;
a hydraulic motor connected to each pump;
hydraulic control means connected to all of said hydraulic motors for activation thereof to supply at least one of the granulated and liquid material to said distributor plates at an adjustable rate which is also proportional to a speed of the vehicle so that at least one of the granulated and liquid material is spread by rotation of said distributor plates;
a feed conduit for granulated material connected between at least one of said trough outlets and the granulated material conduit of a respective distributor means, extendable substantially transversely to the vehicle axis and of a length sufficient to position said respective distributor means outwardly beyond a side contour of the vehicle;
a feed conduit conveyor in said feed conduit;
a hydraulic motor connected to said feed conduit conveyor and to said hydraulic control means, which is activatable with activation of said conveyor hydraulic motor for supplying granulated material to said at least one trough outlet;
a first one of said distributor means being connected to a first trough and conveyor on one side of said vehicle longitudinal axis with a first conveyor hydraulic motor, a first pump hydraulic motor and a first distributor plate hydraulic motor associated therewith;
a second distributor means being associated with a second central trough with a second conveyor hydraulic motor, a second pump hydraulic motor and a second distributor plate hydraulic motor associated therewith;
a third distributor means being associated with a third trough on an opposite side of said longitudinal axis from said first trough, with an associated third conveyor hydraulic motor, a third pump hydraulic motor and third distributor plate hydraulic motor;
said hydraulic control means comprising a first, second and third hydraulic control unit connected to said first, second and third distributor means hydraulic motors respectively;
each hydraulic control unit including two electromagnetic valves which are separately and jointly operable, a hydraulic fluid reservoir, a hydraulic pressure supply pump connected to said reservoir for supplying hydraulic fluid, a hydraulic fluid supply line connected to said hydraulic pressure supply pump, said hydraulic fluid supply line connected to each hydraulic control unit and connectable to each electromagnetic valve, a return line connected between each of said hydraulic control units and said reservoir and connectable to each of said electromagnetic valves;
and a switching unit connected to each of said hydraulic control units for selectively switching said two electromagnetic valves of each hydraulic control unit into a first position for supplying hydraulic fluid to said conveyor hydraulic motors only, to a second position for supplying hydraulic fluid to said pump hydraulic motors only, to a third position for supplying hydraulic fluid to said conveyor and pump hydraulic motors, and to a fourth position for supplying hydraulic fluid to said return line only.

14. A spreader according to claim 13, wherein each of said switch units comprises three electrical closing switches connected in parallel to each other, two of said closing switches connected directly to said two electromagnetic valves respectively for activating said electromagnetic valves with said closing switches closed, and a third closing switch connected over a diode into said two electromagnetic valves for activating both of said electromagnetic valves with said third closing switch closed.

15. A spreader according to claim 13 wherein said hydraulic control means further includes an electromagnetic change gear for generating electronic pulses at a rate proportional to the speed of the vehicle, a proportional valve connected to said change gear for controlling the flow of hydraulic fluid in said hydraulic fluid supply line to flow in an amount proportional to the speed of the vehicle.

16. A spreader according to claim 13, including a pressure divider having three outlets each connected to one of said first, second and third conveyor hydraulic motors and an inlet connected to said hydraulic fluid supply line, a proportional valve in said pressure fluid supply line for regulating the flow of hydraulic fluid as a function of the speed of the vehicle, a second flow divider having outputs connected to each of said first, second and third distributor plate hydraulic motors and an inlet connected to a second hydraulic fluid supply line, a second proportional valve in said second hydraulic fluid supply line for regulating the flow of hydraulic fluid supplied to said distributor plate hydraulic motors manually, said second fluid supply line connected to a second hydraulic pressure supply pump which, in turn, is connected to said hydraulic fluid reservoir.

17. A spreader of granulated and liquid thawing material for a vehicle having a longitudinal axis comprising:
a granulated material vessel on the vehicle having a plurality of feed troughs each having a granulated material outlet;
a conveyor in each trough for conveying granulated material to a respective granulated material outlet;
a hydraulic motor connected to each conveyor;
a liquid material vessel on the vehicle;
distributor means connected to the vehicle and each feed trough outlet;
each distributor means including a rotatable distributor plate, a hydraulic motor connected to each distributor plate, a granulated material conduit connected to a respective feed trough outlet for supplying granulated material to said distributor plate, and a liquid material conduit for supplying liquid material to said distributor plate, said granulated and liquid material conduits structured to maintain a separation of liquid and granulated material up until the vicinity of said distributor plate;

a liquid supply line connected from said liquid material vessel to each liquid material conduit;

a liquid pump in each supply line;

hydraulic motor connected to each pump;

a feed conduit for granulated material connected between at least one of said trough outlets and the granulated material conduit of a respective distributor means, extendable substantially transversely to the vehicle axis and of a length sufficient to position said respective distributor means outwardly beyond a side contour of the vehicle;

a feed conduit conveyor in said feed conduit;

a hydraulic motor connected to said feed conduit conveyor and to said hydraulic control means, which is activatable with activation of said conveyor hydraulic motor for supplying granulated material to said at least one trough outlet; and electromagnetic and hydraulic control means connected to all of said hydraulic motors for activation thereof to supply at least one of the granulated and liquid material to said distributor plates at an adjustable rate which is also proportional to a speed of the vehicle so that at least one of the granulated and liquid material is spread by rotation of said distributor plates;

said electromagnetic and hydraulic control means comprising a control unit associated with each distributor means, each control unit connected to one trough conveyor motor, one distributor plate motor and one liquid pump motor of a respective distributor means, each control unit including electromagnetic valve means connected to each one trough conveyor motor and liquid pump motor, and a return line, said electromagnetic valve means having a first position for supplying hydraulic fluid directly to said return line without activating said one trough conveyor motor and said liquid pump motor, a second position for supplying hydraulic fluid to said one trough conveyor motor while not supplying fluid to said one liquid pump motor, a third position for supplying fluid to said one liquid pump motor but not to said one trough conveyor motor and a fourth position for supplying hydraulic fluid to said one trough conveyor motor and said one liquid pump motor;

each of said distributor means comprising said distributor plate rotatably mounted about a substantially vertical axis, a plurality of impellers connected to an upper surface of said distributor plate, an inner downpiece concentric about said vertical axis and defining therein said liquid material conduit, an outer downpipe positioned concentrically about said inner downpipe and defining with said inner downpipe an annular space forming said granular material conduit, said inner and outer downpipes ending substantially at a plane containing the base of said impellers, said impellers including a first prurality of impellers positioned in said annular space between said inner and outer downpipes, and a second plurality of impellers positioned radially outwardly of said first plurality of impellers and outwardly of said outer downpipe.

18. A spreader according to claim 17, wherein said distributor plate of each distributor means is rotated in an impelling direction, each impeller including a wall portion extending substantially perpendicular to a plane of said distributor plate and an upper portion curved forwardly toward the impelling direction across the entire radial length of each impeller.

19. A spreader according to claim 18, wherein said first plurality of impellers extends substantially radially of said vertical axis and said second plurality of impellers extend at an acute angle to the radial direction from said vertical axis with the radially outer end of each second impeller lagging behind a radially inner end of each impeller in said impelling direction.

20. A spreader according to claim 19, wherein said acute angle is between about 10° and 15°.

21. A spreader according to claim 20, wherein each radially inner end of said second impellers are at the radial position of a corresponding one of said first impellers.

22. A spreader according to claim 17, wherein said inner and outer downpipes each include a lower section extending vertically in the vicinity of said impellers having an arcuately extending opening for the discharge of granulated and liquid material onto said distributor plate, said arcuate extending opening of said inner and outer downpipe lower sections being fixed in position with respect to each other, each lower section being rotatably mounted about said vertical axis with respect to a remainder of said inner and outer downpipes.

23. A spreader according to claim 22, wherein the arcuately extending opening of said inner downpipe lower section extends through a greater arc than the arcuately extending opening of said outer downpipe lower section.

24. A spreader according to claim 23, wherein the arcuately extending opening of said inner outer downpipe lower section extends about 210° around said vertical axis and said arcuately extending opening of said outer downpipe lower section extends for about 180° of arc around said vertical axis.

25. A spreader according to claim 22, wherein a downstream edge of the arcuately extending opening of said inner downpipe lower section, in said impeller direction, is offset by an acute angle upstream of the upstream edge of the arcuately extending opening of said outer downpipe lower section.

26. A spreader according to claim 25, wherein said acute offset angle between said arcuately extending opening is about 45°.

27. A spreacer according to claim 17, wherein said distributor plate includes a truncated conical member extending upwardly from a plane of said distributor plate and into the space defined by said inner downpipe.

* * * * *